US005263508A

United States Patent [19]

Perrott

[11] Patent Number: 5,263,508

[45] Date of Patent: Nov. 23, 1993

[54] SEWER LINE WATER TRAP CHARGING VALVE WITH IMPROVED ADJUSTMENT FOR HOUSE LINE PRESSURE CHANGES

[75] Inventor: Charles H. Perrott, Portland, Oreg.

[73] Assignee: C. H. Perrott, Inc., Portland, Oreg.

[21] Appl. No.: 76,752

[22] Filed: Jun. 15, 1993

[51] Int. Cl.[5] ..... F16K 13/10; F16K 55/24

[52] U.S. Cl. ..... 137/247.25; 137/115; 137/530; 251/251

[58] Field of Search ..... 137/115, 118, 247.25, 137/530; 251/251, 257

[56] References Cited

U.S. PATENT DOCUMENTS

| | | | |
|---|---|---|---|
| 1,970,744 | 8/1934 | Goss | 137/118 |
| 2,408,006 | 9/1946 | Smith | 251/257 X |
| 2,903,233 | 9/1959 | Magor | 251/251 X |
| 2,938,530 | 5/1960 | Matter | 137/115 |
| 3,333,597 | 8/1967 | Sullivan | 137/247.25 X |
| 3,408,040 | 10/1968 | Kraft | 251/257 |
| 3,422,835 | 1/1969 | Watts | 137/115 |
| 4,000,752 | 1/1977 | Miller et al. | 137/118 |
| 4,497,337 | 2/1985 | Mosbrucker et al. | 137/247.25 |

*Primary Examiner*—John Rivell
*Attorney, Agent, or Firm*—Eugene D. Farley

[57] ABSTRACT

A device for charging sever line traps automatically upon decrease in main line water pressure comprising a branch line having a piston valve member telescopically received over the end of an adjustable tubular member, the piston having a first seat for sealing engagement with the end of the tubular member under normal pressure conditions in the main line and a second seat for sealing engagement with the inlet end of the chamber in which the piston and tubular member are mounted when the pressure in the main line is shut off. The piston being unseated from both the end of the tubular member and the end of the chamber, thus permitting flow to the trap, when the main line water pressure is decreased. The piston includes a metering pin for metering the flow of water through the tubular member. Provision also is made for making running adjustments to the valve during its service life as required to compensate for changes in house line pressure.

8 Claims, 1 Drawing Sheet

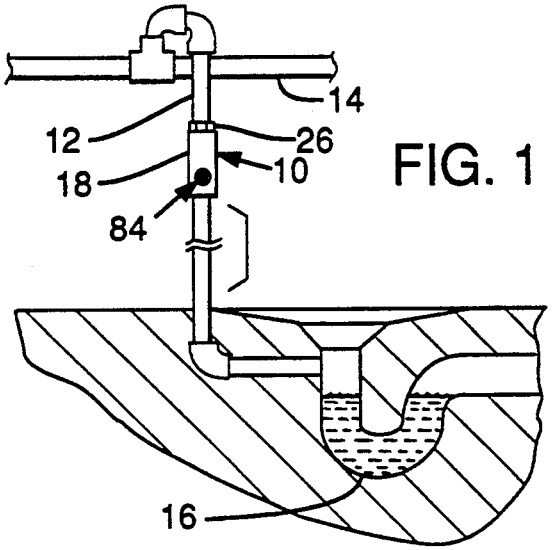
FIG. 1
FIG. 2
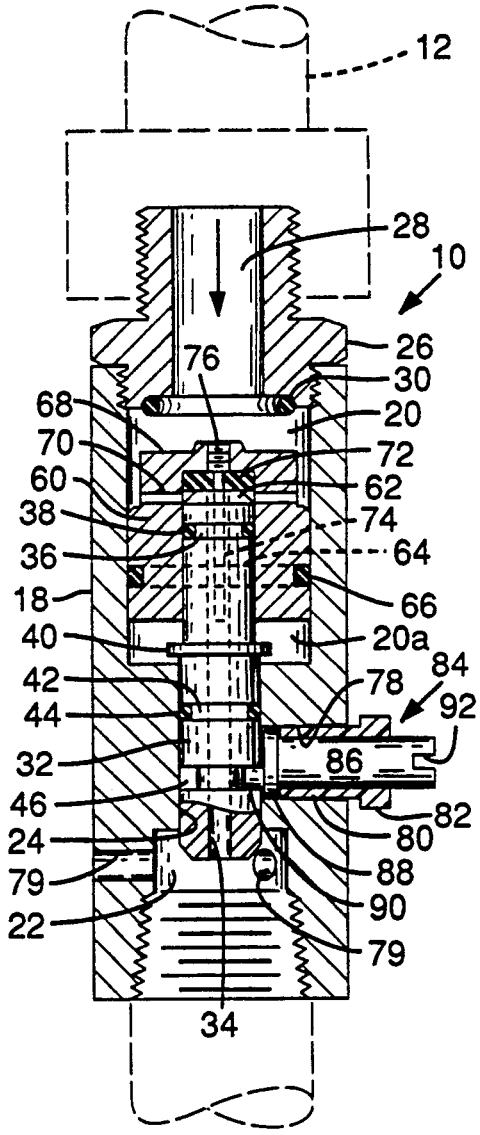
FIG. 3
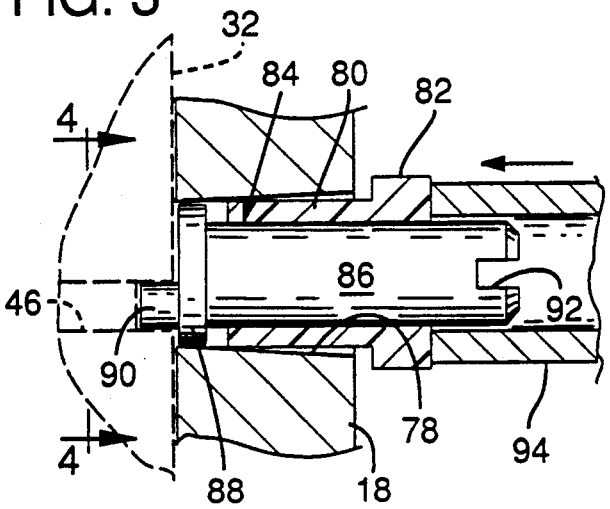
FIG. 4
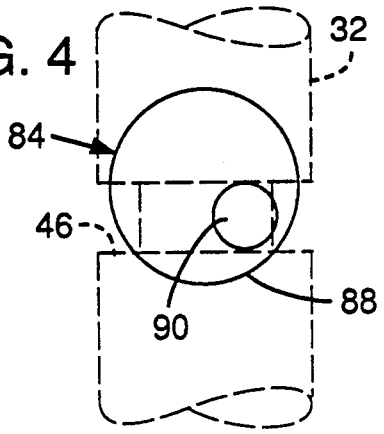

SEWER LINE WATER TRAP CHARGING VALVE WITH IMPROVED ADJUSTMENT FOR HOUSE LINE PRESSURE CHANGES

BACKGROUND OF THE INVENTION

1. Field of the Invention

This invention relates to sewer trap priming valves i.e. to valves for use in charging water into sewer line water traps to prevent the escape of sewer gas.

2. Description of the Related Art

In accordance with conventional building practices, automatic means is provided for supplying water to each sewer line water trap of a structure, automatically and periodically, to ensure that the trap will be operative at all times. It is usual to interconnect the pressured house water line and the sewer trap with a spur water line, and to include in the spur line a priming valve designed to admit water to the trap as required to keep it full and operative.

However, the prior art sewer trap priming valves are subject to failure for various reasons. Since they are required to operate unattended over a long period of time, their moving parts are subject to corrosion. If of the common category actuated by springs, they eventually fail because the springs rust and break. Some categories of priming valves are not subject to adjustment, either initially or during their service life as required by wear or by variations in water line pressure.

Watts U.S. Pat. No. 3,422,835 addresses these problems and provides a partial solution. However, over time a problem is presented in the operation of the Watts valve.

Referring to FIG. 3 of Watts, an adjustment screw 52 drives an eccentric pin 50 working in annular groove 46. Turning the screw adjusts the position of the valve body (tube 32). In this manner the valve may be adjusted from time to time for changes in house line pressure and wear. A lock nut 56 secures the screw, and hence the eccentric pin, in a selected position of valve adjustment.

However, over a period of time, repeated adjustments often result in backing off screw 52 to such an extent that eccentric pin 50 is withdrawn completely from operating groove 46 with the result that the groove drops out of registry with the pin. It then becomes impossible to reinsert the pin and the valve becomes inoperable.

It is the general purpose of the present invention to provide an adjustable sewer line water trap valve having all the advantages of the water valve, but one in which the foregoing problem is overcome.

SUMMARY OF THE INVENTION

In accordance with the present invention, the general structure of the Watts valve is preserved. However, case 18 is provided with an opening radially opposite annular groove 46. A semi-rigid, somewhat malleable, plastic sleeve is seated in this opening.

Screw 52, with lock nut 56 of Watts, then is replaced by an eccentric shaft the eccentric element (pin) of which is received in groove 46 and the outer end of which is provided with a screwdriver slot or other adjustment means.

During assembly, the plastic sleeve is pressed firmly into the opening. Thereupon it deforms sufficiently to lock itself in the opening and to grip the body of the eccentric shaft in such a manner that a frictional relationship is established. The sleeve thus provides a friction bearing which permits radial adjustment of the shaft to any desired position, but which thereafter grips the shaft and maintains it in the position in which it is set, pending a subsequent adjustment.

THE DRAWINGS

In the drawings:

FIG. 1 is a schematic diagram illustrating the manner of installation of the herein described sewer line water trap priming valve.

FIG. 2 is a view in longitudinal section, similar to FIG. of Watts U.S. Pat. No. 3,422,835, but illustrating the valve of the present invention in its closed position.

FIG. 3 is an enlarged, fragmentary, detail view illustrating the construction and manner of installation of the improved valve adjustment subassembly which is the subject matter of the present invention.

FIG. 4 is a fragmentary schematic view, looking in the direction of the arrows 4—4 of FIG. 3, illustrating the manner of operation of the valve adjustment subassembly illustrated in detail in FIG. 3.

DESCRIPTION OF THE PREFERRED EMBODIMENT

Referring to the drawings, with particular regard to FIG. 1, the herein described water trap priming valve 10 of my invention is adapted for insertion in a pressured spur water line 12 which interconnects the house water line 14 and the sewer trap 16. Its function is to keep the trap charged with water at all times so that there is no possibility of escape of sewer gas.

The valve is contained in a case 18 having a doubly stepped bore. The steps of the bore determine an upstream valve chamber 20, a downstream priming water discharge chamber 22 and an intermediate guideway 24.

The upstream end of case 18 is internally threaded to receive a coupling element 26 by means of which the case is connected in spur water line 12. The coupling element has a longitudinal bore 28 which communicates with chamber 20. At its downstream end bore 28 is enlarged to provide an annular seat for a sealing ring 30 which cooperates with the moving components of the valve to seal off the valve in the event of failure of water pressure in the house line, as when the house line is drained, thereby insuring doubly against the transmission of sewer gas through the valve and into the building.

Slidably seated within guideway 24 is a tube 32 having therethrough a longitudinal passageway 34 of predetermined restricted diameter. The upper end of the tube is provided with an annular groove 36 in which is seated O-ring 38; its intermediate portion with an annular flange 40 designed for retention by the upper step of the case bore; and its lower portion with a first annular groove 42 designed to seat O-ring 44, and with a second annular groove 46.

The latter groove cooperates with detent means for retaining tube 32 slidably and adjustably in guideway 24 of the case.

In the illustrated form of the invention the detent means comprises a sleeve and eccentric shaft assembly illustrated particularly in FIGS. 2 and 3. Both elements of this subassembly are mounted in a transverse opening 78 in case 18, located opposite annular groove 46 in tube 32.

Plastic sleeve 80 is dimensioned and contoured for a wedge fit in opening 78. To this end it is fabricated from a rigid, but somewhat malleable plastic having the capacity for deformation when the sleeve is pressed into the opening. Plastics possessing the requisite properties for this purpose comprise Nylon (polyamide resin), Teflon (polytetrafluoroethylene) and, particularly, 10–40% by weight glass filled Delrin having a Rockwell hardness of M75-M90.

The body of the plastic sleeve is contoured for a wedge fit in opening 78. This may be accomplished by tapering one or the other of the meeting surfaces.

To facilitate its use in the final assembly, plastic sleeve 80 preferably is equipped with a bearing pad, or anvil 82 which, in the installed position of the sleeve, extends laterally outwardly from case 18.

Eccentric 84 which is received in frictional working engagement in sleeve 80 comprises a shaft 86 which is mounted rotatably in frictional engagement with plastic sleeve 80; an eccentric disk 88 on the inner end of shaft 86; and an eccentric pin 90 on the inner face of disk 88 in eccentric relation to the axis of shaft 86.

Pin 90 is dimensioned for reception in annular groove 46 in tube 32. It serves as the detent by which the tube is retained slidably and adjustably in guideway 24 of case 18.

Eccentric disk 88 serves the dual functions of mounting eccentric pin 90 and of providing a stop or shoulder against which sleeve 80 is pressed during installation of the eccentric subassembly.

A slotted head 92 on the outer end of shaft 86 provides a means for rotating the shaft and locating eccentric pin 90, and hence tube 32, in any desired position of adjustment.

In the assembly of the eccentric, shaft 86 is inserted in sleeve 80 with eccentric pin 90 received in groove 46. An appropriate pressing tool 94 then is applied to the head 82 of the sleeve in the manner illustrated in FIG. 3. Application of pressure deforms the malleable sleeve and wedges it into opening 78 and into abutment with the outer face of disk 88.

In the resulting working position of the subassembly, both sleeve and eccentric are maintained securely within opening 78. However, when it is desired to adjust the position of pin 90, this may be accomplished by inserting a screwdriver into slotted head 92 of shaft 86 and making the desired rotational adjustment.

If for some reason it is desirable or necessary to remove the eccentric subassembly from opening 78, this can be accomplished by gripping plastic sleeve head 82 with pliers or other suitable tool and forceably withdrawing the subassembly from the opening.

Tube 32 projects into chamber 20 a substantial distance. A cup-shaped piston 60 having an internal longitudinal recess 62 is telescoped over the projecting end of the tube, with its outer side wall in sliding engagement with the inner side wall of chamber 20 and its inner side wall in sliding engagement with the outer side wall of tube 32.

The exterior surface of piston 60 is formed with an annular groove 64 in which is seated sealing ring 66. The piston thus is doubly sealed, internally and externally, by sealing rings 38, 66 respectively, and creates a resilient air cushion 20*a*.

Piston 60 is contoured and arranged so that when the valve is open a flow of water can pass from the upstream end of chamber 20, through the side wall of the piston into recess 62 therein, and thence through the bore 34 of tube 32 for discharge into sewer line trap 16.

To this end piston 60 is formed with a piston head 68 of reduced diameter having through its side walls ports 70 communicating with chamber 20 and recess 62. A flat sealing washer 72 is seated inside the piston head. It, together with the upstream end of tube 32 which seats against it, comprises the primary valve seat by means of which the valve is operated.

Since the diameter of passageway 34 through tube 32 is critical in determining the amount of water which is passed by the valve in its operation, means are provided for determining exactly the effective diameter of the passageway.

As seen in FIG. 2, the means provided for this purpose comprise a rod 74 having a thickened, threaded base 76. Base 76 is threaded into an axial opening through piston head 68. Rod 74 then extends a substantial distance into passageway 34 of tube 32, coaxially therewith. The diameter of the rod determines the amount of water which will be transmitted transmitted by the passageway. If desired, rods of varying diameter may be provided as accessories to vary the capacity of the valve as desirable or necessary in various installations.

To insure against disturbance of the level of water in trap 16 by the development of a vacuum in the line downstream of valve 10, ports 79 are provided in the side walls of the lower portion of case 18, below the downstream discharge end of tube 32.

OPERATION

In its normal operation, valve 10 is inserted as shown in FIG. 1 in pressured water line 12 interconnecting house line 14 and trap 16. Eccentric 84 is adjusted as required to position tube 32 at an elevation with respect to piston 60 such that the piston is placed in an equilibrium position by the opposing forces of water pressure bearing down on piston head 68 from the water system and air pressure bearing upwardly against it from resilient air cushion 20*a* below the piston. In this equilibrium position, illustrated in FIG. 2, the upstream end of tube 32 seats against flat washer 72, closing the valve.

Whenever a faucet or other outlet is opened in house line 14 the pressure in the house line is reduced temporarily. This reduction in pressure is transmitted to spur line 12 with the result that the air pressure of the air cushion in 20*a* pushes the piston upwardly. Water then passes from the house line into the upper portion of chamber 20 through ports 70 through passageway 34 in tube 32, into chamber 22 at the downstream end of case 18, and thence into trap 16. As soon as the faucet or other water outlet in house line 14 is closed, the pressure in house line 14 and also in spur line 12 increases again to its normal value. This retracts piston 60 to the closed position of FIG. 2.

In the event of a major reduction of water pressure in the house line, as when the house line is drained for some purpose, the air pressure of the air cushion in chamber 20*a* behind the piston pushes the piston upwardly until the upstream face of piston head 68 seats securely against sealing ring 30. This renders it impossible for sewer gas to escape into the house line, even though the latter remains drained over a long period of time and even though the water in trap 16 disappears entirely. Then when house line 14 is filled again, the valve instantly becomes operative without any further adjustment.

In the event that during the service life of the valve a running adjustment is required to compensate for changes in house line pressure, such adjustment may be made simply and accurately by adjustment of eccentric 84.

It accordingly will be seen that there is provided an apparatus in which the several objects of this invention are achieved and which is well adapted for the conditions of practical use.

It is to be understood that the form of my invention herein shown and described is to be taken as a preferred example of the same and that various changes in the shape, size and arrangement of parts may be resorted to without departing from the spirit of my invention or the scope of the subjoined claims.

Having thus described my invention, I claim:

1. A valve for charging water into a sewer line trap from a spur water line connecting the trap and a primary water line transporting water under variable pressure, the valve comprising:

(a) a case having a bore longitudinally therethrough, (b) connecting means for connecting the case in series flow in the spur water line, (c) the bore having an enlarged chamber at its upstream end, (d) a tube having a longitudinal passageway of predetermined restricted diameter mounted in the bore of the case with its upstream end projecting into the chamber and having also an annular exterior groove at its downstream end, and (c) detent means for retaining the tube in a predetermined position of longitudinal adjustment within the bore, the detent means comprising:

(1) an opening through he case opposite the annular exterior groove in the downstream end of the tube, (2) a sleeve secured in the opening, and (3) eccentric shaft means rotatably and frictionally mounted in the sleeve in working engagement with the groove.

2. The valve of claim 1 wherein the sleeve is contoured for wedging application and is secured in the opening by wedging.

3. The valve of claim 1 wherein the sleeve comprises a substantially rigid, but malleable plastic.

4. The valve of claim 1 wherein the sleeve comprises a substantially rigid, but malleable plastic of the group consisting of the substantially rigid but malleable Nylon, Teflon and Delrin plastics.

5. The valve of claim 4 wherein the sleeve comprises 10–40% by weight glass-filled Delrin plastic.

6. The valve of claim 1 wherein the sleeve includes a bearing pad located outside the case and useful for pressing or driving the sleeve into the opening into wedging engagement with the opening side walls and the eccentric shaft means.

7. The valve of claim 1 wherein the eccentric shaft means comprises an integral shaft frictionally and rotatably mounted within the sleeve, an eccentric disk on the inner end of the shaft, and an eccentric pin on the disk dimensioned and contoured for insertion in the groove.

8. The valve of claim 7 including a slotted head on the shaft for rotational adjustment of the same.

* * * * *